US006585462B1

(12) United States Patent
Göransson

(10) Patent No.: US 6,585,462 B1
(45) Date of Patent: Jul. 1, 2003

(54) DEVICE IN A TOOL HOLDING ASSEMBLY FOR MOVING A ROTATABLE SHAFT IN THE AXIAL DIRECTION

(75) Inventor: Bo Göransson, Göteborg (SE)

(73) Assignee: SKF Nova AB, Göteborg (SE)

( * ) Notice: Subject to any disclaimer, the term of this patent is extended or adjusted under 35 U.S.C. 154(b) by 198 days.

(21) Appl. No.: 09/709,342

(22) Filed: Nov. 13, 2000

(30) Foreign Application Priority Data

Nov. 10, 1999 (SE) ..... 9904061

(51) Int. Cl.[7] ..... B23C 1/00; B23Q 5/04; B24B 47/10; B23B 39/10

(52) U.S. Cl. ..... 409/231; 409/186; 408/129; 408/238; 408/10; 451/119; 451/124; 82/904; 310/90.5

(58) Field of Search ..... 409/231, 232–233, 409/186–188; 408/129, 124, 238, 10, 6; 451/121, 124, 119, 120; 310/90.5; 82/904

(56) References Cited

U.S. PATENT DOCUMENTS 2,939,250 A * 6/1960 Kline ..... 451/124
2,939,251 A * 6/1960 Greening ..... 451/124
3,753,384 A * 8/1973 Anfindsen ..... 408/129
4,524,543 A * 6/1985 Inoue ..... 451/124
4,784,541 A * 11/1988 Umehara et al. ..... 409/186
4,913,605 A * 4/1990 Schwartzman ..... 409/231
5,345,127 A * 9/1994 New ..... 310/90.5
5,361,543 A * 11/1994 Bory ..... 451/165
5,997,223 A * 12/1999 Kosmowski ..... 409/231
6,227,777 B1 * 5/2001 Kosmowski ..... 409/231

FOREIGN PATENT DOCUMENTS

DE 3123199 12/1982
JP 1-240266 9/1989

* cited by examiner

*Primary Examiner*—William Briggs
*Assistant Examiner*—Erica E Cadugan
(74) *Attorney, Agent, or Firm*—Burns, Doane, Swecker & Mathis, LLP

(57) ABSTRACT

A device in a tool holding assembly for axially moving a rotatable shaft on which is arranged at a first end of the shaft a device for performing work during rotation of the shaft includes an electric motor for rotating the shaft, and at least one bearing radially supporting the shaft and permitting movement of the shaft in the axial direction. The shaft has a second end forming a free end and an electromagnetic mechanism is arranged to affect or operate on the second end of the shaft to draw the shaft in the axial direction from the first end to the second end against the affect of pressure acting against the second end of the shaft in the opposite axial direction. A mechanism controls the electromagnetic mechanism to achieve axial movement of the shaft during rotation of the shaft.

22 Claims, 2 Drawing Sheets

DEVICE IN A TOOL HOLDING ASSEMBLY FOR MOVING A ROTATABLE SHAFT IN THE AXIAL DIRECTION

This application is based on and claims priority under 35 U.S.C. § 119 with respect to Swedish Application No. 9904061-0 filed on Nov. 10, 2000, the entire content of which is incorporated herein by reference.

FIELD OF THE INVENTION

The present invention generally relates to a tool holding assembly. More particularly, the present invention pertains to a device in a tool holding assembly for axially moving a rotatable shaft that carries a work performing device at one end of the shaft.

BACKGROUND OF THE INVENTION

It is advantageous for quality reasons to construct machines for grinding holes so that the grinding wheel during rotation work can also move back and forth in the axial direction. The axial movability of the grinding wheel improves the quality of the holes, i.e., the degree of surface fineness and the straightness of the holes, as compared to a non-oscillating shaft or arrangement. The wear of the grinding wheel is also more uniform and less dressing is needed.

In known machines of this type, the arrangement is such that the entire headstock with the spindle and the grinding wheel must move axially in order to displace the rotating shaft in its axial direction. As the object is to achieve very rapid and short axial movements, these known types of machines are rather unsatisfactory. That is because the entire mass of the headstock, the spindle and the grinding wheel must be displaced rapidly, which requires a very stiff and clearance-free bearing arrangement as well as a powerfull driving motor. Also, the wear on the headstock and driving mechanism is high which means that a relatively lot of maintenance is typically necessary.

In manufacturing processes today, the speed of production is high and the speed of rotation is often well above 100,000 r/min. This means that in known types of machines, the rotatable shaft cannot move or oscillate axially at a satisfactorily high speed because the higher the speed of production, the higher speed of the axial motion that is necessary to achieve high quality in the performed work.

The big mass that must be moved in known machines is in the size range of 50–100 kg. This mass can cause vibration and limit the speed of oscillation and thereby the speed of production.

There has thus existed for a relatively long time a high commercial demand for a satisfactory solution to the above-described problems. While the problems mentioned above have been described in connection with grinding wheel, the same problems also exist in connection with other machineries with a rotatable shaft that carries a mechanism for performing work during rotation of the shaft. One such example is a drilling machine intended to perfom very small and fast axial movements, such as for use in manufacturing circuits cards.

German Patent Publication No. DE 31 23 199 A1 describes a construction for axially oscillating a rotating shaft on which a working tool, such as a grinding wheel, is arranged. The oscillation is achieved with the aid of two springs arranged at the opposite sides of a disk positioned on the shaft. The springs act against each other and are brought into sympathetic vibration for oscillation of the shaft in the axial direction. The device described in this German publication suffers from several drawbacks and disadvantages. The mass that is brought into oscillation is rather large which, as mentioned above, is a rather serious problem. Another significant disadvantage is that the speed of oscillation is restricted to the resonance frequency of the spring system.

Another attempted solution is described in Japanese Patent Publication No. 1-240266. This document describes a construction involving a rotatable shaft provided with a radially extending rotor and an electromagnet arranged on each side of said rotor. The shaft is oscillated axially by controlling the magnitude of the current to each one of the electromagnets and thereby the magnetic forces on the rotor. One drawback with this construction is that the rotor arranged on the shaft is rather heavy and this makes the rotating axis even heavier, which restricts speed of rotation of the shaft. Another drawback is that this construction, requiring the use of two electromagnets, is rather expensive. A further significant difficulty with the construction according to this Japanese publication is that the electromagnets and the rotor require a lot of space.

SUMMARY OF THE INVENTION

The device in accordance with the present invention is adapted to be used in a tool holding assembly for axially moving a rotatable shaft on which is arranged, at a first end of the shaft, a device for performing work during rotation of the shaft. The shaft possess a free second end, and an electro-magnetic mechanism is provided to affect the second end of the shaft and draw the shaft in the axial direction from the first end to the second end against the affect of pressure acting against the second end in the opposite axial direction. A device controls the electromagnetic mechanism to achieve the axial movement of the shaft during rotation of the shaft.

According to one form of the invention, the electromagnetic mechanism includes a journal arranged with its free end adjacent the second end of the shaft and a magnetic coil arranged around the journal for generating a magnetic field in the axial direction of the journal. The journal, magnetic coil and an end part of the shaft adjacent the second end are encased in a housing arranged to guide the magnetic field in a closed loop that includes the end part of the shaft, the journal and a gap between the second end of the shaft and the free end of the journal, whereby the magnetic field acts on the end part of the shaft with a force in a direction against the free end of the journal.

In the device in accordance with the present invention, just the rotatable shaft is moved or oscillated in the axial direction. The small mass that moves or oscillates increases the possibility for high accelerations and an optimized pattern of movement. The axial movement of the shaft is thus not restricted to a sinus form.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements and wherein.

DETAILED DESCRIPTION OF THE INVENTION

Figure 1:
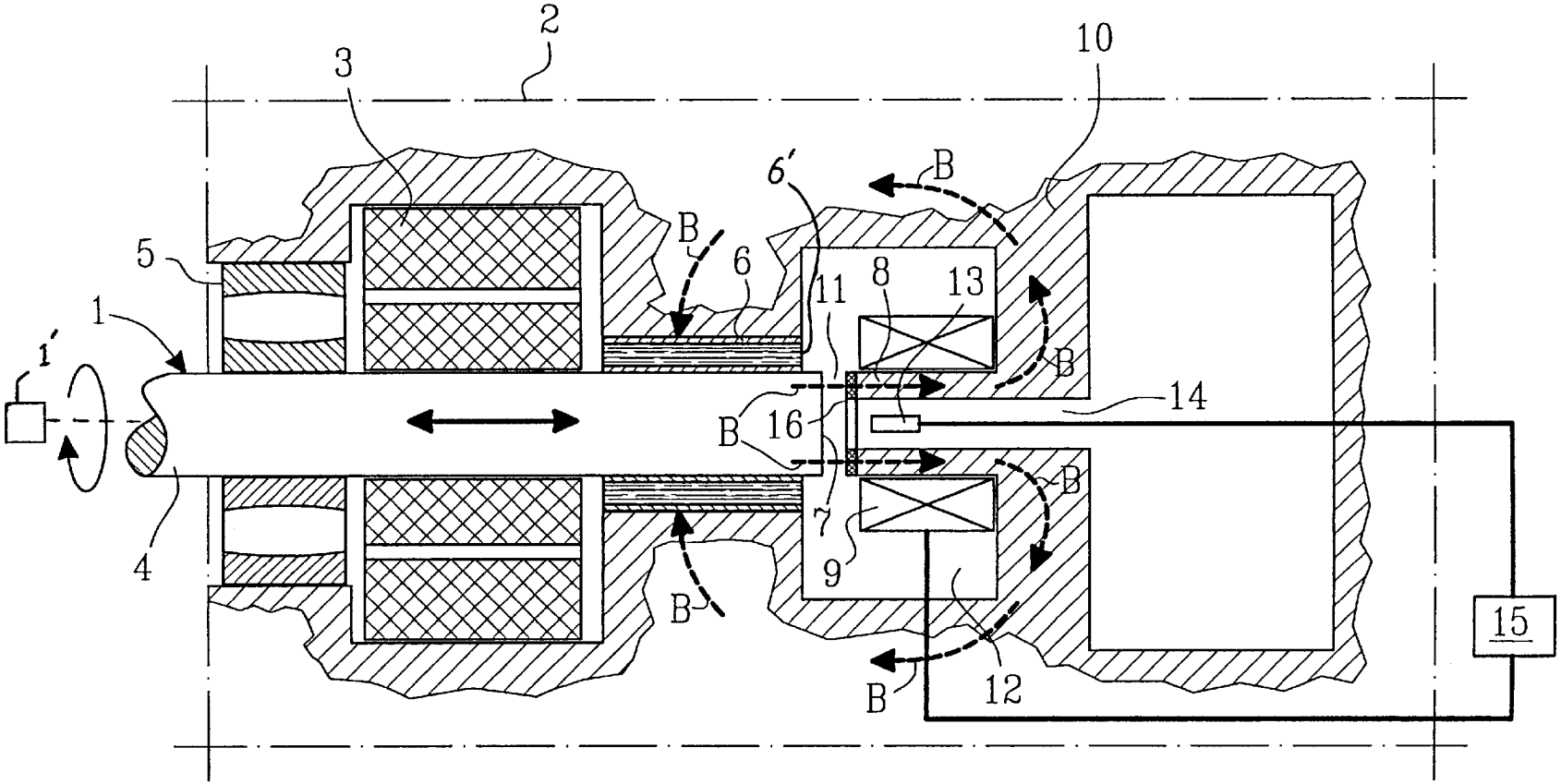
FIG. 1 is a schematic cross-sectional view of a first embodiment of the present invention.

Referring initially to FIG. 1, an embodiment of the present invention is described in the context of providing axial movement and high precision positioning of a rotatable shaft 1 in a stationary machinery unit 2, such as a headstock of a grinding machine. An electric motor 3 is operatively associated with the shaft 1 to transfer power to the rotatable shaft 1 and rotate the shaft for performing work during rotation.

The shaft 1 is designed to carry a tool, such as a grinding wheel in a first end 4 of the shaft. The tool 1' is schematically shown in FIG. 1. The shaft 1 is supported by two bearings, a rolling bearing 5, such as a rolling bearing sold under the trademark CARB, and a gas bearing 6. The bearings are arranged for displacement in the axial direction, e.g. by axial bearing play.

The bearings 5, 6 may also be hydrostatic or hydrodynamic bearings which have a scaling function and allow axial movements. The bearing 6 is non-magnetic or contains nonmagnetic material to a certain thickness around the shaft in order to reduce radial forces on the shaft caused by the magnetic field.

The shaft also has a second end 7, and a journal 8 is arranged with its free end adjacent to and facing this second end 7 of the shaft 1. A magnetic coil 9 is arranged around the journal 8 for generating a magnetic field in the axial direction of the journal 8. The magnetic field is designated B in the drawing figures. The journal 8, the magnetic coil 9 and an end part of the shaft 1 adjacent the second end 7 are encased in a housing 10 which is arranged to guide the magnetic field generated by the coil 9 in closed loops including the end part of the shaft 1, the journal 8 and a gap 11 between the second end 7 of the shaft and the free end of the journal 8. The magnetic field acts on the end part of the shaft 1 with a force in the direction against the free end of the journal 8.

The housing 10 surrounds a space 12 including the gap 11 between the second end 7 of the shaft and the free end of the journal 8. Gas from the gas bearing 6 leaks into the space 12 which is sealed so that an overpressure is created in the space. The magnitude of the overpressure is regulated with a valve which is schematically shown at 6' in FIG. 1.

The shaft 1 is drawn in the axial direction from the first end 4 to the second end 7 by the magnetic field against the effect of the overpressure acting against the second end 7 of the shaft 1.

A position detecting mechanism 13 is arranged in a bore hole 14 passing through the journal 8. The position detecting mechanism 13 detects the axial position of the shaft 1 and emits a corresponding signal indicative of the shaft position to a control device 15.

The control device 15 is arranged to control the current flowing in the electromagnetic coil 9 in response to the signal from the position detecting mechanism 13 in order to control axial movement of the shaft 1.

The control device 15 is programmed to control the magnitude of the current in the electromagnetic coil 9 in order to move or oscillate the shaft 1 and the grinding wheel in an optimized way for effecting high quality grinding with respect to surface roughness, bore straightness and with uniform wear and long intervals between dressing of the grinding wheel.

The overpressure regulating valve mentioned above also serves as a safety mechanism which is arranged to open for purposes of eliminating the overpressure when the magnetic field due to failure disappears. Preferably, the safety mechanism is a magnetic valve connected to and controlled by the control device 15.

One significant advantage associated with the device in accordance with the present invention is that only a minimal mass must be moved for moving/oscillating the grinding wheel in the axial direction of the shaft. That is, only the shaft 1 and the grinding wheel are moved. This relatively small movable mass makes it possible to program the control device 15 to guide the shaft to perform an optimized pattern of movement. The movement is not restricted to sinus form and high acceleration of the shaft 1 with the grinding wheel is possible in the axial direction of the shaft.

The magnetic force between the second end 7 of the shaft 1 and the free end of the journal 8 increases when the distance between the ends is reduced. According to a preferred embodiment, a landing bearing is arranged on the end surface of the free end of the shaft 1 and/or on an end surface of the free end of the journal 8. In the embodiment shown in FIG. 1, the landing bearing includes a graphite layer or coating 16 applied on the end surface of the free end of the journal 8 to prevent the second end of the shaft from coming into direct contact with the free end of the journal 8 if the magnetic control should malfunction. The graphite layer must have a certain thickness or must be applied on a layer or a washer of a non-magnetic material (not shown) so that the combined thickness is sufficiently high. Direct contact of the ends or an excessively small distance between the ends during work rotation could lead to the spindle being destroyed if the regulation system fails. The graphite layer 16 serves as a wear resistant surface and is arranged, possibly in combination with other nonmagnetic material, to limit the magnetic force. With the graphite layer 16, possibly in combination with a further non-magnetic layer or washer, the two ends can come in contact at least for a short period without the risk that the spindle will become damaged.

Instead of the graphite layer or coating, the landing bearing could instead be a washer formed of graphite. Other suitable material for the layer, coating or the washer include non-magnetic material with low friction, such as synthetic diamond. Further examples of nonmagnetic material include a layer of air or a layer formed of ceramic balls.

Figure 2:
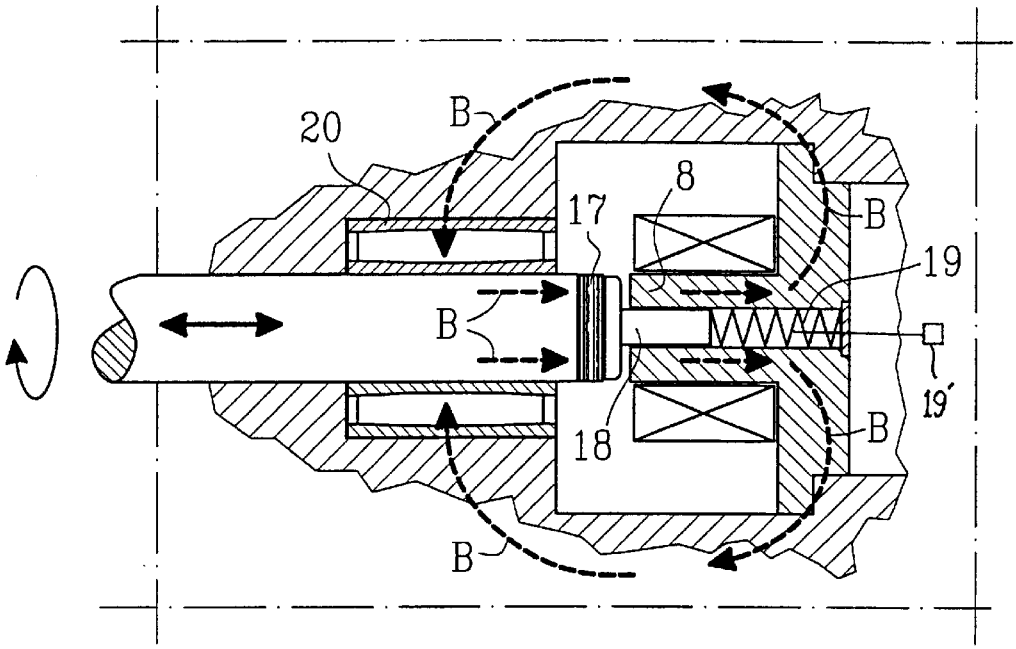
FIG. 2 is a schematic cross-sectional view of a second embodiment of the present invention.

In the embodiment of the present invention shown in FIG. 2, a gas bearing 17 is arranged between the second end 7 of the shaft 1 and the facing end of the journal 8. The gas bearing 17 is adapted to act against the second end of the shaft and a piston 18 is provided to transfer force from a spring 19 via the gas bearing to the shaft. This embodiment of the present invention is suitable when high axial forces are needed such as when the invention is used in a drilling machine. In the embodiment according to FIG. 2, the radial bearing close to the second end of the shaft 1 is a cylindrical bearing 20.

High axial forces can be tranferred without the aid of the spring shown in FIG. 2 if an air piston arrangement (not specifically shown) is used.

In the embodiment of the present invention shown in FIG. 2, the axial force must be quickly decreased if the electromagnetic mechanism generating the magnetic field B fails or stops working. If the axial forces acting against the forces generated by the magnetic field are produced by a spring 19 as shown in FIG. 2, the action of the spring can be controlled by a known magnetic mechanism which brings the spring to an inactive position when the electromagnetic means fails or stops working. Such mechanism is schematically shown as 19' in FIG. 3.

If an air piston is used instead of a spring, a magnetic valve can be provided to decrease the air pressure when the electromagnetic mechanism fails or stops working.

The landing bearing on the end surface of the free second end of the shaft and/or on the end surface of the free end of the journal need not to be a coating or a washer as described above. Other suitable examples of landing bearings include gas bearings, aerostatic bearings and aerodynamic bearings. It is to be understood that the illustrations in the drawing figures of the landing bearing are intended to generically represent various possible forms of the landing bearing including those mentioned above.

Figure 3:
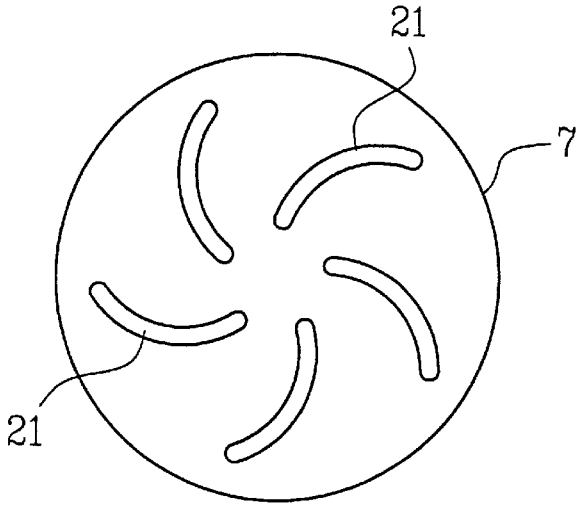
FIG. 3 is a schematic illustration of the principle associated with one example of a landing bearing for taking up forces in the axial direction of a shaft.

The aforementioned aerodynamic bearing could for example be acieved by arranging spiral grooves 21 in the end surface of the second end 7 of the shaft 1 as shown in FIG. 3. Air pressure is then achieved outside the end surface when the shaft 1 rotates.

The aerodynamic bearing, for instance in the form of spiral grooves as shown in FIG. 3, could also be used to create the pressure acting against the second free end 7 of the shaft.

The grooves can of course have forms or shapes other than spiral grooves. For example, the grooves can have the form of or be shaped as herringbone grooves.

When the whole spindle assembly is moved toward the work piece, for instance for grinding a hole in the work piece, the spindle in known devices would be destroyed if the spindle under high speed missed the hole and crashed against the end surface of the work piece. In a preferred embodiment of the present invention, a mechanism such as the detection mechanism 13 in the embodiment shown in FIG. 1, is arranged to detect when the actual axial position of the shaft during movement of the spindle assembly towards the work piece differs from a reference position, which deviation from the reference position indicates that unexpected forces have acted against the shaft. As the shaft in the device according to the invention can move axially a distance in relation to the spindle, a time period exists for a signal to be sent from the detection mechanism to the control device to stop the advancement of the spindle before it crashes in a stiff condition, i.e., with the free end of the shaft lying directly aginst the free end of the journal possibly with a landing bearing in between, towards the work piece.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A device in a tool holding assembly for axially moving a rotatable shaft on which is arranged at a first end of the shaft a device for performing work during rotation of the shaft, comprising a driving device for effecting rotation of the shaft, and at least one bearing radially supporting the shaft and permitting movement of the shaft in the axial direction, the shaft having a free second end, electromagnetic means arranged relative to the shaft for drawing the shaft in the axial direction from the first end toward the second end in opposition to pressure acting against the second end in an opposite axial direction, and control means for controlling the electromagnetic means to achieve the axial movement of the shaft during rotation of the shaft, said electromagnetic means comprising a stationary journal having a free end positioned axially adjacent the second end of the shaft and a magnetic coil arranged around an exterior of the journal for generating a magnetic field.

2. The device according to claim 1, wherein the driving device is an electric motor.

3. The device according to claim 1, wherein the free end of the journal faces the free second end of the shaft.

4. The device according to claim 1, wherein the journal, the magnetic coil and an end part of the shaft adjacent the second end are encased in a housing that is arranged to guide the magnetic field in closed loops including the end part and the journal and a gap between the second end of the shaft and the free end of the journal so that the magnetic field acts on the end part of the shaft.

5. The device according to claim 4, wherein the housing surrounds a space including the gap between the second end of the shaft and the free end of the journal, and including means arranged to create in said space said pressure acting against the second end of the shaft.

6. The device according to claim 5, including a bearing supporting the end part of the rotatable shaft, said bearing including non-magnetic material around the shaft to limit radial magnetic forces on the end part of the rotatable shaft.

7. The device according to claim 6, wherein the bearing at the end part of the shaft is a gas bearing and said pressure is achieved by gas leakage from the gas bearing.

8. The device according to claim 1, including a landing bearing positioned on at least one of an end surface of the second end of the rotatable shaft and an end surface of the free end of the journal.

9. The device according to claim 8, wherein the landing bearing comprises a washer or coating formed of non-magnetic material.

10. The device according to claim 9, wherein the non-magnetic material is synthetic diamond.

11. The device according to claim 8, wherein the landing bearing is a gas bearing.

12. The device according to claim 8, wherein the landing bearing is an aerostatic bearing.

13. The device according to claim 8, wherein the landing bearing is an aerodynamic bearing.

14. The device according to claim 13, wherein the aerodynamic bearing is formed as a plurality of grooves provided on at least one of the end surface of the second end of the shaft or the end surface of the journal, the grooves creating an increased air pressure outside the end surface of the second end of the shaft when the shaft rotates.

15. The device according to claim 14, wherein the grooves are spiral grooves.

16. The device according to claim 13, wherein the aerodynamic bearing is arranged to also create the pressure acting against the second end of the shaft.

17. The device according to claim 1, including position detecting means for detecting at least the axial position of the shaft and for emitting a signal to the control means for controlling the electromagnetic means, the control means controlling current flowing in the electromagnetic means in response to the signal from the position detecting means in order to control axial movement of the shaft.

18. The device according to claim 1, including a gas bearing or a hydrostatic bearing positioned between the second end of the shaft and the journal to act against the second end of the shaft, and including means for applying a force against the second end of the shaft via the gas bearing or hydrostatic bearing for generating the pressure which acts against the second end of the shaft.

19. The device according to claim 18, wherein said means for applying a force against the second end of the shaft via the gas bearing or hydrostatic bearing is a spring.

20. The device according to claim 19, including safety means for inactivating said spring when the electromagnetic means fails or stops working.

21. The device according to claim 1, including detecting means for detecting when an actual axial position of the shaft during movement towards a workpiece differs from a reference position, which deviation from the reference position indicates unexpected forces acting on the shaft, the control means being adapted to stop advancement of the shaft towards the work piece when the detecting means detects the deviation.

22. The device according to claim 1, including safety means for relieving the pressure acting against the second end of the shaft when the electromagnetic means fails or stops working.

* * * * *